US005842851A

United States Patent [19]

Pivot

[11] Patent Number: 5,842,851

[45] Date of Patent: Dec. 1, 1998

[54] INDUCED AIR CATALYTIC BURNER, AND APPARATUS INCORPORATING SUCH A BURNER

[75] Inventor: Jean-Claude Pivot, Vourles Vernaison, France

[73] Assignee: Application des Gaz, Paris, France

[21] Appl. No.: 623,004

[22] Filed: Mar. 28, 1996

[30] Foreign Application Priority Data

Apr. 5, 1995 [FR] France ..... 95 04290

[51] Int. Cl.[6] ..... F23D 14/12

[52] U.S. Cl. ..... 431/328; 431/7; 431/268; 431/329; 431/10; 431/267

[58] Field of Search ..... 431/7, 268, 328, 431/329, 10, 267

[56] References Cited

U.S. PATENT DOCUMENTS

| | | | |
|---|---|---|---|
| 3,441,359 | 4/1969 | Keith et al. . | |
| 4,911,143 | 3/1990 | Pivot et al. . | |
| 5,228,847 | 7/1993 | Lywood et al. | 431/268 X |
| 5,251,609 | 10/1993 | Thibault et al. . | |
| 5,281,128 | 1/1994 | Dalla Betta et al. | 431/7 |
| 5,380,192 | 1/1995 | Hamos | 431/7 |
| 5,474,441 | 12/1995 | Farrauto et al. | 431/268 X |
| 5,577,906 | 11/1996 | Hanakata et al. | 431/268 |

FOREIGN PATENT DOCUMENTS

| | | |
|---|---|---|
| 0313479 | 4/1989 | European Pat. Off. . |
| 0520913 | 12/1992 | European Pat. Off. . |
| 0524643 | 1/1993 | European Pat. Off. . |
| 1228433 | 8/1960 | France . |
| 2678360 | 9/1993 | France . |
| 57-153737 | 9/1982 | Japan . |
| 59-041706 | 3/1984 | Japan . |

OTHER PUBLICATIONS

P.D.L. Mercera et al., "Zirconia as a Support for Catalysts", *Applied Catalysis*, 71 (1991), pp. 363–391.

*Primary Examiner*—Larry Jones
*Attorney, Agent, or Firm*—Oliff & Berridge, PLC

[57] ABSTRACT

A device for oxidizing a gas mixture that includes at least one hydrocarbon and oxygen. The device contains a porous solid that consists of zirconia. At least one metal having a catalytic oxidation activity, for example platinum or palladium, is deposited on the solid support. The device also contains an induced-air catalytic burner for the catalytic combustion of gaseous hydrocarbon mixed with atmospheric air and a member for dissipating the heat generated within the solid support. The device develops an average thermal power of at least 10 W/cm$^2$ and an average temperature within the support of at least 700° C.

17 Claims, 1 Drawing Sheet

INDUCED AIR CATALYTIC BURNER, AND APPARATUS INCORPORATING SUCH A BURNER

FIELD OF THE INVENTION

The present invention relates in general to the catalytic combustion of a gaseous hydrocarbon, such as butane or propane, natural gas, mixed with atmospheric air.

BACKGROUND OF THE PRIOR ART

More precisely, but not exclusively, the present invention pertains to so-called induced-air catalytic burners, that is to say making it possible to burn a gaseous hydrocarbon premixed with atmospheric air, and without influx of secondary air. In practice, and as described in particular in documents FR-A-2,678,360 and EP-A 0,313,479, such burners are incorporated or contained in portable or nonportable apparatuses of the domestic or industrial type, having various functions or uses, such as soldering, cooking, heating, etc.

Conventionally, and as shown in FIGS. 1 and 2 in the appended drawing, an induced-air catalytic burner generally comprises:

- a passive or active member 4 for admixing combustion air with the gaseous hydrocarbon, which may, in practice, consist of an injector 7, from which a gaseous stream of pressurized hydrocarbon emerges, and a venturi 8 arranged coaxially and at some distance from the injector, in order to leave an interstice for admission of combustion air;
- a support 5, having a mechanical function, which is permeable, made of thermochemically inert material, and determines an inlet face 5*a* for the mixture to be burned and an outlet face 5*b* for the waste gases; by way of example, this support is a ceramic matrix, for example made of cordierite, of the honeycomb type, comprising a plurality of parallel channels 5*c* connecting the inlet face 5*a* to the outlet face 5*b;*
- a porous solid phase 1, applied to the support 5, having a large specific area, at least partly coating the internal surface of the support 5, often called "washcoat";
- a metal 2 having a catalytic oxidation activity, generally a noble or precious metal, for example platinum and/or palladium, deposited on the porous solid phase;
- and means 6 for dissipating the heat generated within the support 5, for example in the form of a mass of metal, possibly belonging to the bit of a soldering iron, for example.

Thermochemically inert material is understood to mean a material resistant both to temperature, for example above 700° C., and to any form of chemical or corrosion attack under these conditions and the use environment, including relatively high temperature.

In accordance with documents U.S. Pat. No. 3,441,359 and JP-A-59,041,706, the porous solid phase 1, termed "washcoat", consists of zirconia in granular form, coating the internal surface of the support 5 in a continuous manner.

By way of example, and as used in the test procedures referred to hereinbelow, such a catalytic burner has the following dimensions and compositions:

- the support 5 of the honeycomb type is made of porous cordierite, the pore volume of which is about 40% of the apparent volume of said support, with an average pore diameter of about 5 $\mu$m, and the walls of the channels 5*c* determine square cells, the pitch of which is 1.20 mm, and have a thickness of 0.20 mm; the transverse dimension, namely the diameter of the cylinder-shaped support, is 10.7 mm, and the longitudinal dimension, along the direction of flow of the gases, especially of the mixture to be burned, namely the thickness or axial dimension, is 8 mm;
- the porous solid phase 1, termed "washcoat", itself has a large internal developed surface area, with respect to its apparent surface area, of about 100 $m^2/g$ for example; it is obtained by preparing an aqueous suspension containing approximately 45% by weight of dry zirconia, and approximately 0.5% by weight of an organic surfactant, by impregnating the support 5 with said suspension, by drying said support and by calcining the latter at 500° C.; the porous solid phase represents about 15% by weight of the support 5;
- the support 5 coated with the porous solid phase of zirconia is immersed in an aqueous solution containing 6% by weight of yttrium nitrate, one molecule of which is associated with six molecules of water; next, the support is dried and calcined as previously; this makes it possible to introduce approximately 3% by weight of yttrium oxide, with respect to the porous solid phase 1, termed "washcoat", in order to increase the thermal stability of the latter;
- the metal 2 having a catalytic oxidation activity is deposited by impregnation, then drying and firing on the porous solid phase 1, termed "washcoat", in a proportion of 0.3% of platinum with respect to the total weight of the finished catalyzer, for example by using an acetone solution of chloroplatinic acid, the acid assay being about 0.5 to 1% by weight of the solution.

On account of the relatively high operating temperatures and the relatively high surface power densities developed by these catalytic burners, the present invention pertains to their lifetime, having regard to that of the gas apparatuses in which they are incorporated, in such a way that at least the combustion catalyst, consisting of the support with its porous solid phase ("washcoat") and the catalytic metal, is changed as late as possible or lasts as long as possible.

"Lifetime" is understood to mean the time after which the combustion catalyst has essentially lost its catalytic combustion function or activity, in such a way that the burner is no longer capable of going from an open-flame combustion regime to a flameless catalytic combustion regime, or goes from one regime to the other after much too long a time, with due regard to the waiting time acceptable to the user of the apparatus in which said burner is incorporated.

In practice, this lifetime may be measured using the following experimental procedure, with the catalytic burner described with reference to FIGS. 1 and 2 and exemplified previously:

(a) the central zone of the permeable support 5 is blocked over a diameter of 5.5 mm in order to limit the heating to the center of said support;

(b) the catalytic burner works with butane comprising 60 mol % of unsaturated compounds, at a flow rate of 4.65 g/h and with an excess of combustion air of 5% with respect to the stoichiometric combustion quantity, which enables a power of about 100 $W/cm^2$ per unit area of the working section of the inlet face 5*a* to be obtained;

(c) the burner works in cycles of 25 hours in operation, with a one hour stoppage;

(d) a new work cycle begins with butane comprising 30 mol % of unsaturated compounds and with a flow rate of combustion air representing 0.5 times the stoichiometric combustion quantity; once the catalytic combustion regime has been obtained, the burner works under the feed conditions as in (b);

(e) a catalytic burner is regarded as being nonoperational if the time to go from open-flame combustion to flameless combustion exceeds 3 minutes.

Currently, with a traditional zirconia as "washcoat", under the experimental conditions defined previously, and for the burner exemplified hereinabove, the lifetime of the catalyst does not exceed 100 hours.

With respect to the catalytic reaction, it is known that the catalyst lifetime, which is generally limited, constitutes a key parameter in the performance of the catalytic reaction and its operation or use on an industrial scale.

This same question has in fact been the focus of attention in other fields of application of heterogeneous catalysis, for example in the field of catalytic exhaust emission control for an internal-combustion engine, which represents a technical field completely different from that of the catalytic combustion of a combustible gas.

Thus, in the field of catalytic exhaust emission control, in accordance with Japanese document JP-A-57,153,737, a catalyzer has been proposed for a catalytic converter of a motor vehicle, preferably in a discrete or particulate form, comprising a support without any "washcoat", consisting of alumina with a high proportion (of about from 30 to 80% by weight of the alumina) of zirconia, and on which is deposited directly the metal having the required catalytic activity, in this case complete oxidation of the residual hydrocarbons, carbon monoxide and nitrogen oxides. The Japanese document JP-A-57,153,737 makes no mention of the use of alumina mixed with zirconia, as a "washcoat" deposited on a support. With regard to the support, it is pointed out that the zirconia incorporated in the alumina has a particle size of between 0.5 and 10 $\mu$m, which makes it possible principally to limit the quantity of catalytic metal, especially noble metal, for the same catalytic activity, and secondarily to increase the lifetime of the catalyst, for the same quantity of catalytic metal.

On account of the very different technical problems or working conditions in a catalytic converter, compared to a catalytic burner, especially in terms of operating temperatures, which are much lower for a catalytic converter, the solution proposed by the Japanese document JP-A-57,153,737 cannot be envisaged by one skilled in the art for a catalytic burner, the more so because, in this case, the zirconia forms part of the support itself and is not itself considered as a "washcoat".

SUMMARY OF THE INVENTION

According to the present invention, it has been discovered, surprisingly, that the lifetime of the previously defined combustion catalysts depended on the particle size of the zirconia-based porous solid phase, or "washcoat". More precisely, it has been discovered that this lifetime was optimized for zirconia particles having a size of between 1 and 5 $\mu$m and preferably between 2.5 and 4.5 $\mu$m, and was done so without compromising the catalytic efficiency of the catalyst, especially in terms of combustion rate.

This discovery was made with the catalytic burner exemplified previously, by measuring the lifetime as defined above and by correlating the latter with the particle size of the initial dry zirconia, having been used to obtain the porous solid phase 1, or "washcoat".

This particle size is measured on various initial dry zirconias by means of a "*Coultronics Coulter LS* 130" apparatus with a suspension prepared as follows:

approximately 0.1 g of the initial zirconia is suspended in 250 ml of an aqueous solution containing 0.1% of sodium hexametaphosphate;

this suspension is subjected to ultrasound for 5 minutes and then mechanically stirred for 1 minute;

and 1 ml of this suspension is diluted in 1.5 l of water; it is this dilution which is subjected to the particle-size analysis using the aforementioned apparatus.

From these tests, the results expressed in the table below are obtained.

| Average particle size ($\mu$m) | Number of tests | Average lifetime (h) |
|---|---|---|
| 0.13 | 4 | 130 |
| 1.62 | 4 | 150 |
| 2.27 | 2 | 90 |
| 3.20 | 4 | 180 |
| 3.90 | 2 | 210 |
| 4.20 | 4 | 125 |

Such characteristics make it possible to envisage appreciable lifetimes for induced-air catalytic burners under high heat load, being characterized both by an average thermal power of at least 10 W/cm$^2$ and an average temperature within the support of at least 700° C. These performance characteristics are determined by the design of the catalytic burner, by appropriately adapting and dimensioning the burner's admixing member and its dissipating means in relation to the total cross section of the permeable support.

The observations made according to the invention represent a major step forward since, for the same lifetime of an induced-air catalytic burner, it becomes possible to use much less catalytic metal, compared to the prior solutions. It is, in fact, commonly accepted that increasing the quantity of catalytic metal increases the lifetime of a combustion catalyst.

The particle size defined above also leads to good penetration of the "washcoat" into the internal surface of the support.

DETAILED DESCRIPTION OF PREFERRED EMBODIMENTS

Figure 1:
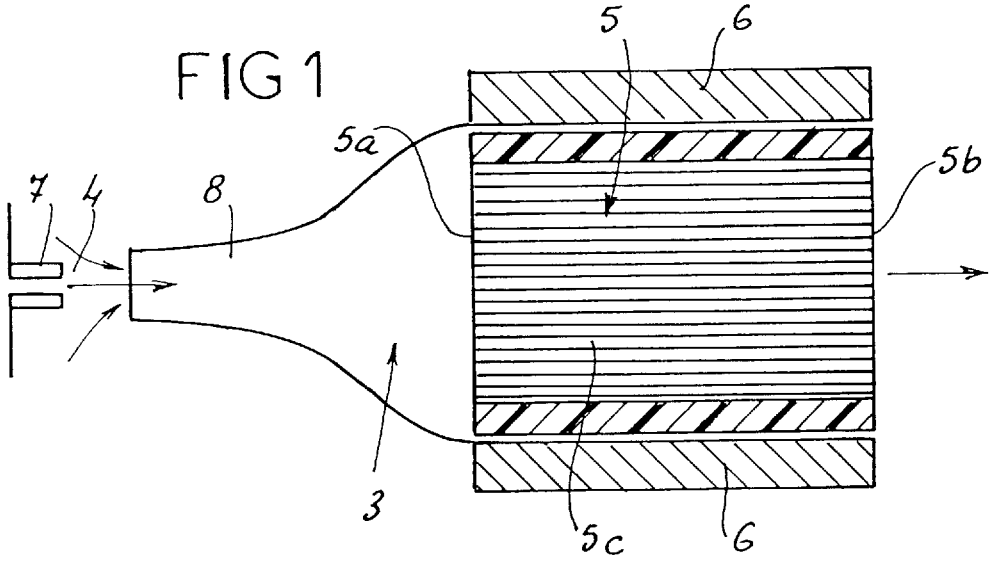
FIG. 1 demonstrates an induced-air catalytic burner having a permeable support having a plurality of parallel channels.
Figure 2:
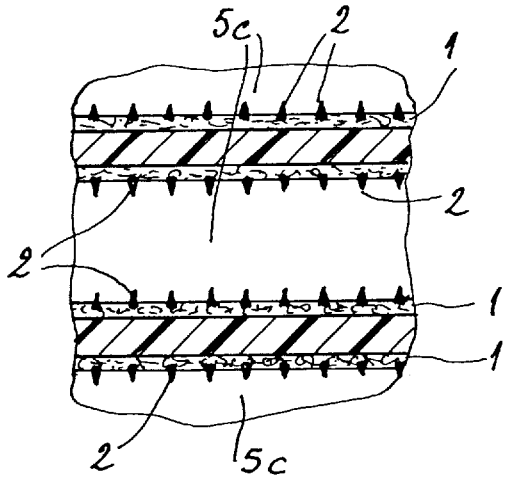
FIG. 2 is an enlarged view of a channel of the permeable support.

The present invention also has the following technical characteristics:

the permeable support 1 may be replaced by a sheet of fibers of thermochemically inert material, the fibers being mutually entangled and providing between them a relatively large internal developed surface area;

the zirconia comprises a monoclinic crystalline phase;

the porous solid phase 1, or "washcoat", comprises, by way of addition, a chemical element belonging to Groups IIa and IIIb of the Periodic Table of the Elements, especially yttrium or lanthanum, in oxide form;

the porous solid phase 1, termed "washcoat", consists entirely of zirconia;

the porous solid phase, termed "washcoat", represents at most 25%, and preferably about from 10 to 20%, by weight of the support 1;

the admixing member 4 and the dissipating means 6 are designed and dimensioned, in relation to the average cross section of the permeable support 5, to develop an average thermal power of at least 10 W/cm$^2$ with an average temperature within said support of at least 700° C.;

the admixing member 4 is designed or dimensioned, in relation to the rest of the burner 3, to supply a mixture to be burned which contains an excess of air, especially at most equal to 50%, and preferably about 10%, with respect to the stoichiometric combustion quantity;

the permeable support 5 has a longitudinal, especially axial, dimension along the direction of flow of the gases, especially of the mixture to be burned, which is less than its transverse, especially diametral, dimension perpendicular to the direction of flow of the gases;

as stated previously, a burner according to the invention may form part of any gas apparatus, especially a portable apparatus, having especially one of the following functions, namely soldering, cooking and heating.

I claim:

1. An induced-air catalytic burner for catalytic combustion of a gaseous hydrocarbon mixed with atmospheric air, said burner comprising:

a member for admixing said gaseous hydrocarbon with said atmospheric air;

a permeable support made of a thermochemically inert material, said permeable support comprising an inlet face for accepting a mixture to be burned and an outlet face for discharging waste gases, wherein an internal surface of said permeable support is at least partly coated with a porous solid phase comprising zirconia particles having a particle size of between 1 and 5 $\mu$m, onto which is deposited a metal having a catalytic oxidation activity; and means for dissipating heat generated within said support.

2. The burner as claimed in claim 1, wherein said porous solid phase, consists entirely of zirconia.

3. The burner as claimed in claim 2, wherein said porous solid phase represents at most 25% by weight of said support.

4. The burner as claimed in claim 2, wherein said porous solid phase represents about 10 to 20% by weight of said support.

5. The burner as claimed in claim 1, wherein the admixing member and the dissipating means are designed and dimensioned, in relation to the average cross section of the permeable support, to develop an average thermal power of at least 10 W/cm$^2$ with an average temperature within said support of at least 700° C.

6. The burner as claimed in claim 1, wherein said member for admixing is positioned in relation to the rest of the burner to supply a mixture that contains an excess of air less than or equal to 50% with respect to a stoichiometric combustion quantity of air to be burned.

7. The burner as claimed in claim 1, wherein the permeable support has a longitudinal dimension along the direction of flow of the gases and a transverse dimension perpendicular to the direction of flow of the gases, wherein said longitudinal dimension is shorter than said transverse dimension.

8. The burner as claimed in claim 1, wherein the permeable support comprises a ceramic matrix comprising a plurality of parallel channels connecting the inlet face to the outlet face.

9. The burner as claimed in claim 1, wherein said permeable support comprises fibers of thermochemically inert material that are mutually entangled, wherein said entangled fibers provide an internal developed surface area.

10. The burner as claimed in claim 1, wherein the zirconia comprises a monoclinic crystalline phase.

11. The burner as claimed in claim 1, wherein said porous solid phase further comprises a chemical element selected form the group consisting of groups IIa and IIIb of the Periodic Table of the Elements in oxide form.

12. The burner as claimed in claim 11, wherein said porous solid phase further comprises yttrium oxide.

13. The burner as claimed in claim 11, wherein said porous solid phase further comprises lanthanum oxide.

14. The burner as claimed in claim 1, wherein said burner is portable having a function selected from the group consisting of soldering, cooking and heating.

15. The burner as claimed in claim 1, wherein said support comprises zirconia particles having diameters from 2.5 $\mu$m to 4.5 $\mu$m.

16. The burner as claimed in claim 1, wherein said member for admixing is positioned to supply a mixture that contains an excess of air less than or equal to about 10% with respect to a stoichiometric combustion quantity of air to be burned.

17. The burner as claimed in claim 1, said porous solid phase consisting essentially of said zirconia particles.

* * * * *